US012465131B2

(12) United States Patent
Martinezzo

(10) Patent No.: US 12,465,131 B2
(45) Date of Patent: Nov. 11, 2025

(54) APPLICATOR BOTTLE

(71) Applicant: ZEYRRO PTY LTD, Woodlands (AU)

(72) Inventor: John Martinezzo, Woodlands (AU)

(73) Assignee: ZEYRRO PTY LTD, Woodlands (AU)

( * ) Notice: Subject to any disclaimer, the term of this patent is extended or adjusted under 35 U.S.C. 154(b) by 0 days.

(21) Appl. No.: 18/832,027

(22) PCT Filed: Jun. 9, 2023

(86) PCT No.: PCT/AU2023/050507
§ 371 (c)(1),
(2) Date: Jul. 22, 2024

(87) PCT Pub. No.: WO2023/235931
PCT Pub. Date: Dec. 14, 2023

(65) Prior Publication Data

US 2025/0113909 A1 Apr. 10, 2025

(30) Foreign Application Priority Data

Jun. 10, 2022 (AU) ..... 2022901593

(51) Int. Cl.
*A45D 34/04* (2006.01)
*A45D 34/06* (2006.01)
(Continued)

(52) U.S. Cl.
CPC ..... *A45D 34/045* (2013.01); *A45D 34/042* (2013.01); *A45D 34/06* (2013.01);
(Continued)

(58) Field of Classification Search
CPC .. B65D 21/0231; A45D 34/06; A45D 34/042; A45D 34/045; A45D 40/262; A45D 40/265; A45D 40/24
(Continued)

(56) References Cited

U.S. PATENT DOCUMENTS 3,194,426 A * 7/1965 Brown, Jr. ..... B65D 21/0204 222/143
3,862,683 A * 1/1975 Koelichen ..... B43M 99/007 401/35
(Continued)

FOREIGN PATENT DOCUMENTS

CA 182328 S 2/1918
FR 2902083 A1 12/2007

OTHER PUBLICATIONS

International Preliminary Report on Patentability dated May 22, 2024 from PCT Application No. PCT/AU2021/050507 (6 pages).
(Continued)

*Primary Examiner* — Jennifer C Chiang
(74) *Attorney, Agent, or Firm* — INNOVATION CAPITAL LAW GROUP, LLP; Vic Lin

(57) ABSTRACT

An applicator bottle has a container and a lid having an applicator which collects fluid from the floor when the lid engages the opening. The applicant bottle may have fluid saving capabilities wherein the container defines an opening into an interior which funnels fluid concentrically towards a floor opposite the opening when the container is upright so that the applicator can collect fluid pooled on the floor when the lid engages the opening without wastage. The container may also be configured for side-by-side interlocking and/or vertical stacking.

20 Claims, 8 Drawing Sheets

(51) Int. Cl.

| | |
|---|---|
| ***A45D 40/24*** | (2006.01) |
| ***A45D 40/26*** | (2006.01) |
| ***B65D 21/02*** | (2006.01) |

(52) U.S. Cl.
CPC ..... *A45D 40/24* (2013.01); *A45D 40/262* (2013.01); *A45D 40/265* (2013.01); *B65D 21/0231* (2013.01); *A45D 2200/053* (2013.01); *A45D 2200/1036* (2013.01)

(58) Field of Classification Search
USPC ..... 401/17, 18, 35
See application file for complete search history.

(56) References Cited

U.S. PATENT DOCUMENTS

| | | | | |
|---|---|---|---|---|
| 5,947,622 | A | 9/1999 | Akyildiz et al. | |
| 9,290,300 | B2 * | 3/2016 | Hendrickson | E04H 7/22 |
| 10,441,052 | B1 * | 10/2019 | Tapocik | A45D 34/00 |
| 10,472,152 | B2 * | 11/2019 | Geier | B65D 71/70 |
| D883,032 | S | 5/2020 | Bodum | |
| 11,129,462 | B2 | 9/2021 | Spinelli et al. | |
| 2003/0147685 | A1 | 8/2003 | Epli | |
| 2014/0086662 | A1 | 3/2014 | Arney | |

OTHER PUBLICATIONS

International Search Report & Written Opinion dated Jul. 13, 2023 from PCT Application No. PCT/AU2023/050507 (14 pages).

* cited by examiner

APPLICATOR BOTTLE

FIELD OF THE INVENTION

This invention relates generally to an applicator bottle having fluid saving, usability and/or interlocking capabilities.

SUMMARY OF THE DISCLOSURE

There is provided herein a bottle comprising a container and a lid having an applicator which collects fluid from the floor when the lid engages the opening.

In an embodiment, the applicant bottle has fluid saving capabilities wherein the container defines an opening into an interior which funnels fluid concentrically towards a floor opposite the opening when the container is upright so that the applicator can collect fluid pooled on the floor when the lid engages the opening.

The bottle may be used for a variety of fluids of varying viscosities to eliminate wastage and to avoid having to manipulate the applicator into corners to reach remaining fluid.

The floor may be planar and a distal end of the applicator may be conformably planar so as to uniformly collect fluid across the entire surface of the floor. The applicator may comprise longitudinally orientated splayed bristles or a dauber which defines a planar face conforming to the planar floor.

Furthermore, the floor may have a width greater than a maximum width of the applicator but not by much so that the distal end of the applicator can cover substantially the entire surface area of the floor.

The distal end of the applicator may be configured to just reach the floor when the lid engages the neck of the container.

The bottle may be configured so that the applicator compresses against the floor to assist absorption of fluid, especially where the applicator comprises a dauber.

In embodiments, the container may be configured for side-by-side interlocking or vertical stacking. In embodiments, the container is configured for both side-by-side interlock and vertical stacking.

Other aspects of the invention are also disclosed.

BRIEF DESCRIPTION OF THE DRAWINGS

Notwithstanding any Other Forms which May Fall within the Scope of the Present Invention, Preferred Embodiments of the Disclosure Will Now be Described, by Way of Example Only, with Reference to the Accompanying Drawings in which.

DESCRIPTION OF EMBODIMENTS

Figure 1:
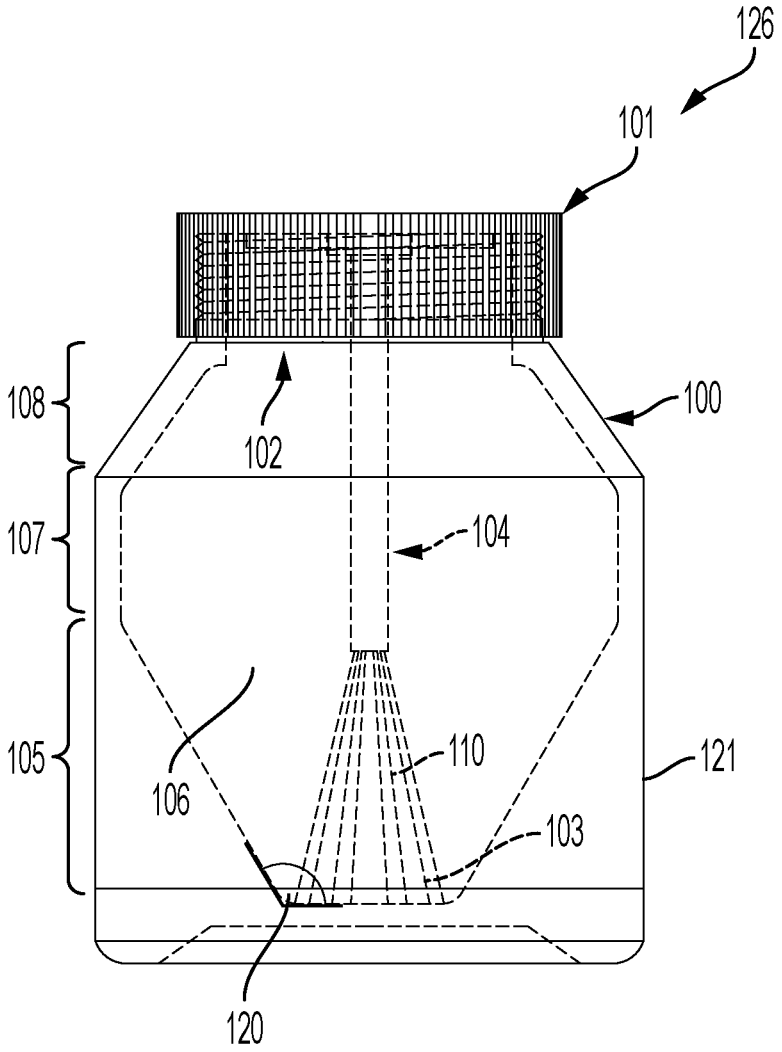
FIG. 1 shows a cross-sectional elevation view of an applicator bottle in accordance with an embodiment.

An applicator bottle 126 comprises a container 100 defining a neck 127 having an opening 102 into an interior 106 which funnels fluid concentrically towards a floor 103 opposite the opening 102 when the container 100 is upright. A lid 101 having an applicator 104 collects the fluid from the floor 103 when the lid 101 engages the opening 102 of the container 100.

The bottle 126 may be used for a variety of fluids of varying viscosities to eliminate wastage and to avoid having to manipulate the applicator 104 into corners to reach remaining fluid.

As shown in FIG. 1, the container 100 may comprise a funnelled section 105 wherein the interior 106 funnels towards the floor 103, a midsection 107 wherein the interior 106 is cylindrical and a shoulder 108 wherein the interior 106 narrows towards the opening 102.

Figure 10:
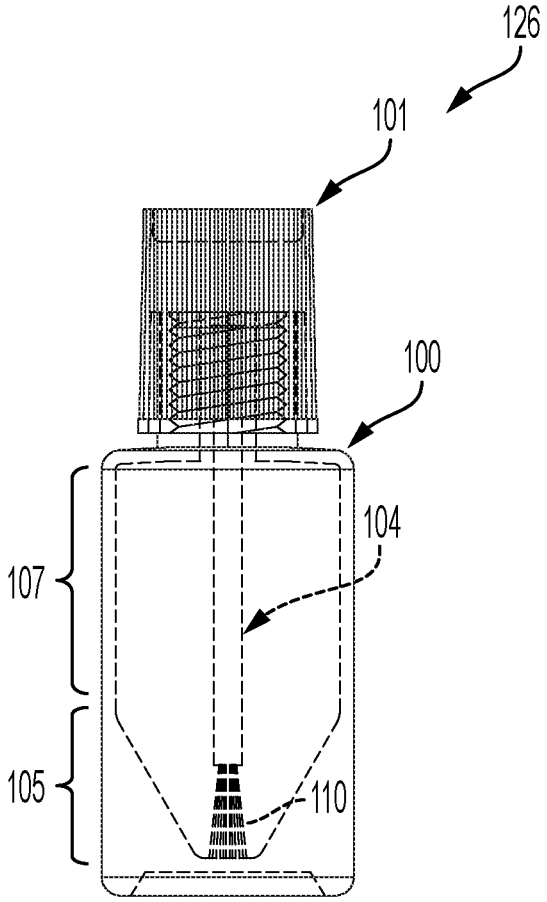
FIG. 10 shows a cross-sectional view of an applicator bottle in accordance with a yet further embodiment.

According to the embodiment shown in FIG. 1, the neck 127 may have an exterior diameter of approximately 44 mm and an interior diameter of approximately 38 mm. Furthermore, the neck 127 may comprise a height of approximately 15 mm. Furthermore, the funnelled section 105, midsection 107 and shoulder 108 may comprise a height of approximately 83 mm. In the embodiment shown in FIG. 1, the funnelled section 105 has a height greater than that of the midsection 107. However, for certain types of narrow containers 100 as is shown in FIG. 10, the midsection 107 may have a height greater than the funnelled section 105.

Figure 3A:
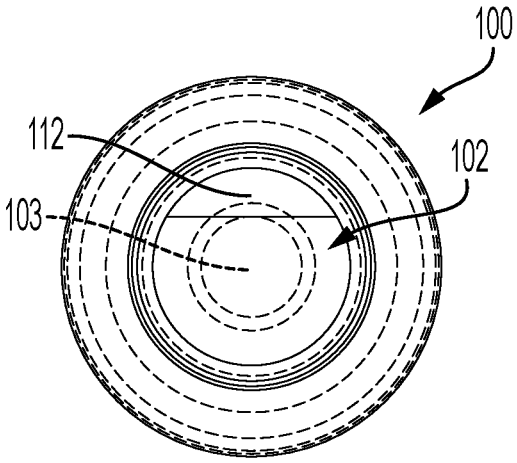
FIG. 3A shows a top plan view of a container of the embodiment of FIG. 1.
Figure 3B:
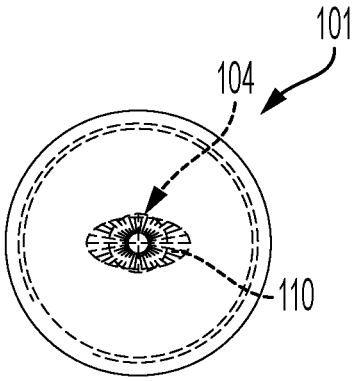
FIG. 3B shows a top plan view of the lid of the container of FIG. 1.

As shown in FIG. 3, the container 100 preferably has a cylindrical cross-section and wherein the floor 103 and a distal end 109 of the applicator 104 are concentric when the lid 101 engages the opening 102.

As is shown in FIG. 3, the floor 103 may be planar and the applicator 104 may comprise a distal end 109 which is conformably coplanar. As such, in the manner illustrated in FIG. 1, the distal end 109 of the applicator 104 is able to uniformly spread across the planar floor 103 to adequately soak fluid therefrom.

Figure 2:
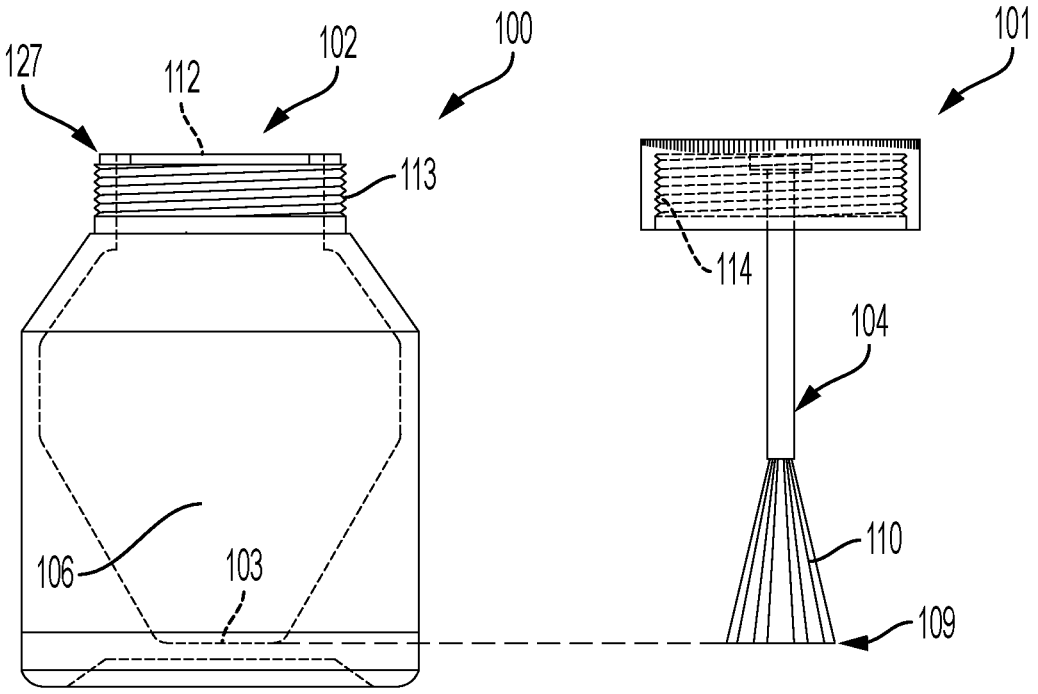
FIG. 2 shows a lid disconnected from a container of the embodiment of FIG. 1.
Figure 9:
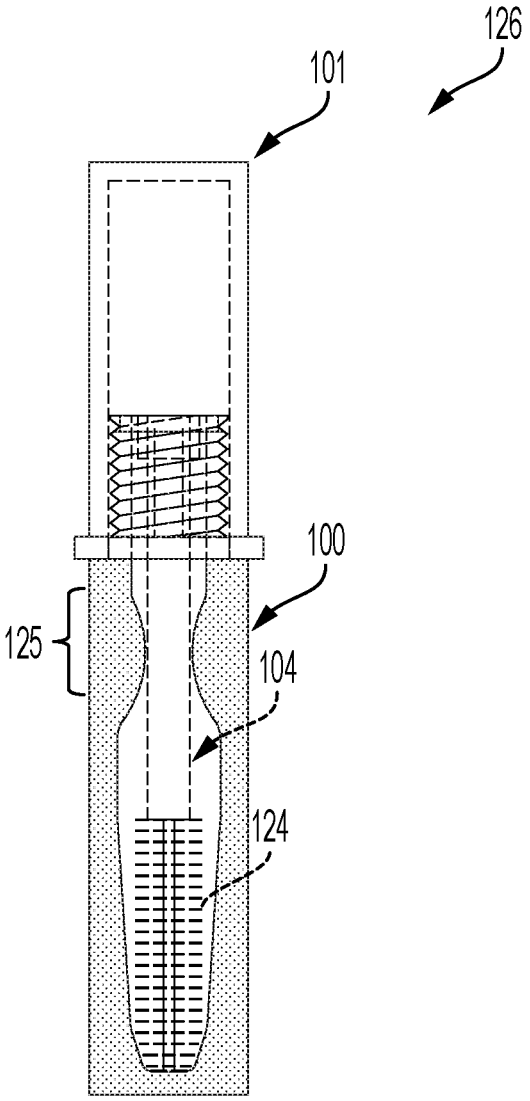
FIG. 9 shows a cross-sectional elevation view of an applicator bottle in accordance with a yet further embodiment.

In the embodiment shown in FIG. 2, the applicator 104 comprises generally longitudinally orientated bristles 110. Furthermore, the bristles 110 may be splayed to define the planar distal end 109. FIG. 9 shows an alternative embodiment wherein the applicator 104 comprise radially orientated bristles 124.

Figure 4:
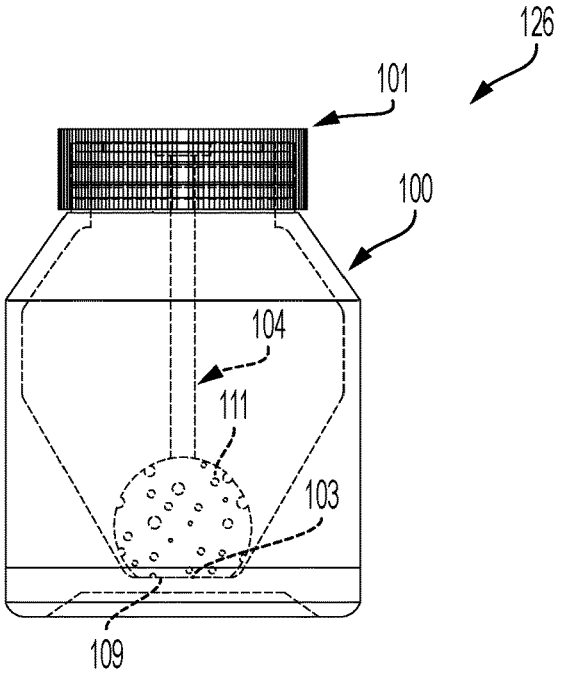
FIG. 4 shows a cross-sectional elevation view of an applicator bottle in accordance with a further embodiment.

FIG. 4 shows a yet further alternative embodiment wherein the applicator 104 comprises a dauber 111 such as of sponge, foam or the like. A distal face of the dauber 111 may be planar to thereby conform with the planar floor 103.

As is illustrated in FIG. 1, a distal end 109 of the applicator 104 may be sized to cover substantially the entire surface area of the floor.

As is illustrated in FIG. 1, the floor 103 is preferably wider than a maximum width of the distal end 109 of the applicator 104, but not by much, preferably not more than 25% wider.

Where the applicator 104 comprises splayed bristles 110 as shown in FIG. 1, the width of the floor 103 may be greater than the widest extent of the bristles 110 but not by much.

As is shown in FIG. 3, the bristles 110 may be elliptical and may comprise a minimum diameter of approximately 10 mm and a maximum diameter of approximately 20 mm. In accordance with this embodiment, the floor 103 may comprise a width greater than the maximum diameter of the bristles 110, in this case, being wider than 20 mm, but preferably not wider than 25 mm.

Similarly, for the embodiment wherein the applicant 104 comprises a dauber 111 is shown in FIG. 4, the floor 103 may be wider than a distal face of the dauber 111.

As is further illustrated in FIG. 4, wherein the dauber 111 is substantially spherical, the dauber 111 may comprise a diameter greater than the width of the floor 103 but wherein the distal face 109 of the dauber 111 yet comprises a diameter less than the width of the floor 103.

FIG. 3 shows wherein the container 100 comprises a wiping shelf 112 partially across the opening 102. The applicator 104 may be wiped against the edge of the shelf 112 to remove excess fluid which drips back to the floor 103 from the shelf 112. In the embodiment shown, the shelf 112 is straight edged, thereby suitable for the generally elliptical bristles 110 shown in FIG. 3. However, in alternative embodiments, the edge of the shelf 112 may be conformably curved to the shape of the applicator 104.

Figure 15:
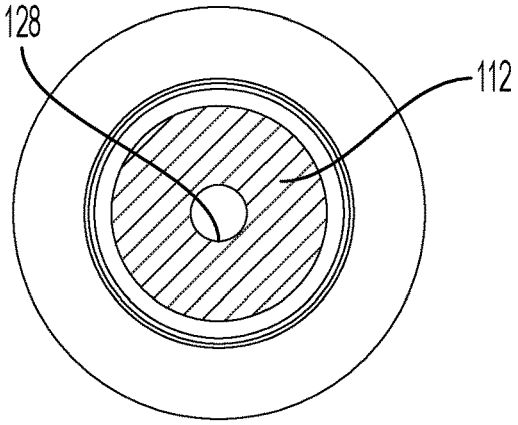
FIG. 15 shows a top view of applicator bottle wiping shelf in accordance with an embodiment.

FIG. 15 shows an alternative embodiment wherein the wiper shelf 112 is annular, thereby defining a circular wiping edge 128. In alternative embodiments, the wiping edge 112 may be ovular to conform to the cross-section of the bristles 110.

Figure 16:
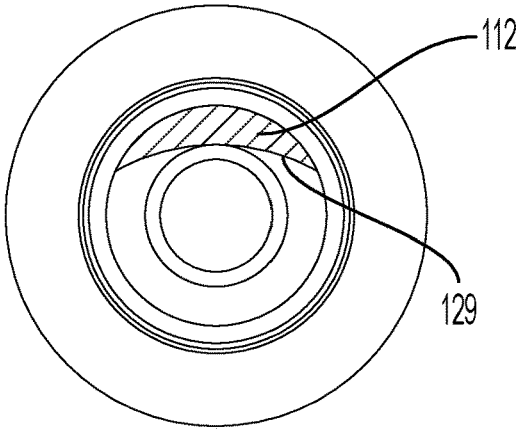
FIG. 16 shows a top view of applicator bottle wiping shelf in accordance with a further embodiment.
Figure 17:
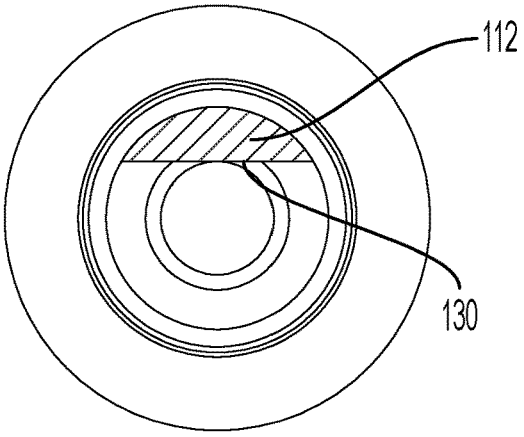
FIG. 17 shows a top view of applicator bottle wiping shelf in accordance with a further embodiment.

FIG. 16 shows an alternative embodiment wherein the shelf 112 has a curved wiping edge 129 and FIG. 17 shows wherein the shelf 112 has a straight wiping edge 130.

In embodiments, the wiper shelf 112 may be concave or downwardly angled so that excess fluid flows back down from the edge thereof or through the apertures thereof into the container 100. The angle of the concave wiper shelf 112 may be configured according to the viscosity of the fluid so that the fluid flows from the wiper shelf 112 back into the interior of the container 101 without building up on the wiper shelf 120. In embodiments, the wiper shelf 112 may be angled downwardly in excess of 20°.

As is shown in FIG. 1, the applicator may be configured to just touch the floor 103 when the lid 101 engages the neck 127.

Figure 5:
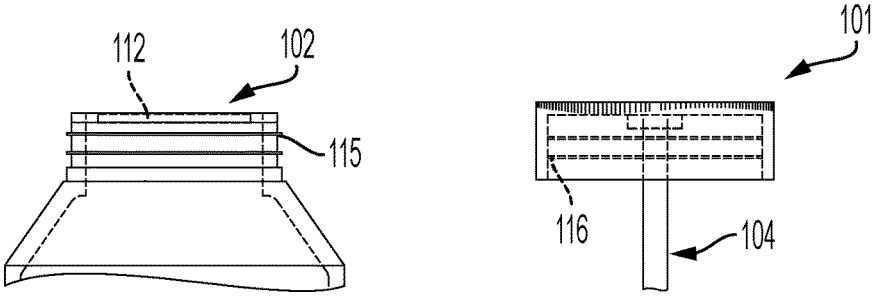
FIG. 5 illustrates a press fit engagement in accordance with an embodiment.

FIG. 2 shows an embodiment wherein the neck 127 comprises exterior threading 113 which turns into interior threading 114 of the lid 101. FIG. 5 shows an alternative embodiment wherein the neck 127 comprises exterior ribs 115 which press fit against corresponding interior ribs 116 of the lid 101.

In one embodiment, the distal end 109 of the applicator 104 is configured to just touch the floor 103 when the lid 101 first engages the neck 127. In accordance with this embodiment, the applicator 104 may reach the floor 103 without the user having to fully screw or press the lid 101 onto the container 100.

Further in accordance with this embodiment, when the lid 101 engages the neck 127, the applicator 104 may compress slightly against the floor 103.

In particular, for the embodiment wherein the applicant 104 comprises a dauber 111, the slight compression of the dauber 111 may aid absorption of the fluid. In other words, when the dauber 111 is pressed against the floor 103, the sponge 103 compresses slightly and when the lid 101 is removed from the container 100, the dauber 111 decompresses, thereby absorbing fluid from the floor 103. In accordance with this embodiment, the distal face of the dauber 111 may not be planar but may, for example, be rounded (wherein the entire dauber 111 is spherical) but which compresses flat against the floor 103.

In embodiments, the dauber 111 may comprise a width greater than the floor 103 so that the dauber 111 is not only compressed against the floor 103 along a longitudinal axis of the applicator 104 but is constricted against the funnelled interior 106.

In alternative embodiments, the distal end 109 of the applicator 104 is configured to just touch the floor 103 when the lid 101 fully engages the opening, that is when the lid 101 is fully screwed or pressed onto the opening 102. In accordance with this embodiment, the applicant 104 is able to soak collected fluid from the floor 103 without deforming.

Figure 6:
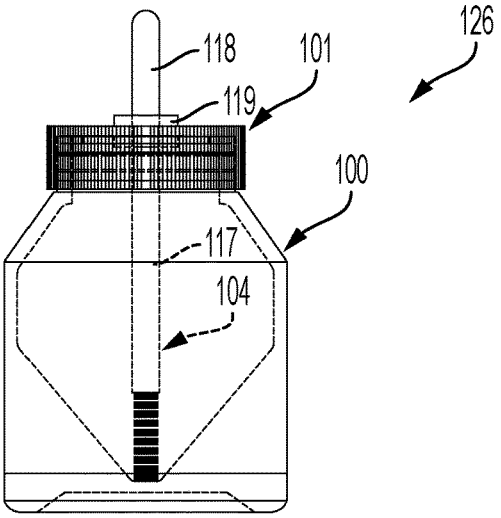
FIG. 6 shows a cross-sectional elevation view of an applicator bottle in accordance with a yet further embodiment.

FIG. 6 shows an embodiment wherein the applicator 104 is removable from the lid 101. Specifically, the applicant 104 may comprise a shaft 117 defining a proximal end 118 which goes through the lid 101. In embodiments, threading may engage the shaft 117 and the lid 101 so that the shaft 117 can be unscrewed from the lid 101. An annular sealing flange 119 may fluidly seal the applicator 104 and the lid 101. The flange 119 may be either exteriorly or interior located depending on which side of the lid 100 the applicator 104 is removed from.

In embodiments, the flange 119 may slidably engage the shaft 117 of the applicator 114 so that the relative offset of the distal end of the applicator 104 with respect to the lid 101 may be adjusted, including to position the applicator most appropriately within fluid within the container 100.

In embodiments, as opposed to the proximal end 118 of the shaft 117 being used as the handle, the lid 101 itself may comprise a formation thereatop defining a handle grip. In embodiments, the handle grip may have a maximum diameter correspond substantially with that of the lid 101.

The interior 106 may be funnelled at an angle proportionate to liquid content viscosity. In other words, the greater the viscosity, the greater the angle of the funnelled interior. Generally, the interior 106 may be funnelled at an angle so that the fluid contents therein return to the floor 103 within a reasonable time depending on the viscosity thereof, such as wherein 80% of the fluid content returns to the floor 103 within a minute or less.

The interior 106 may be funnelled at between 110-140° with respect to the floor 103. The embodiment shown in FIG. 1 has an angle 120 of approximately 120° between the funnelled interior 106 and the floor 103.

FIG. 1 shows an embodiment wherein an exterior 121 of the container 100 adjacent the funnelled section 105 is cylindrical. In other words, the exterior 121 diverges away from the interior 106 at the funnelled section 105 towards the bottom of the container 100.

Figure 7:
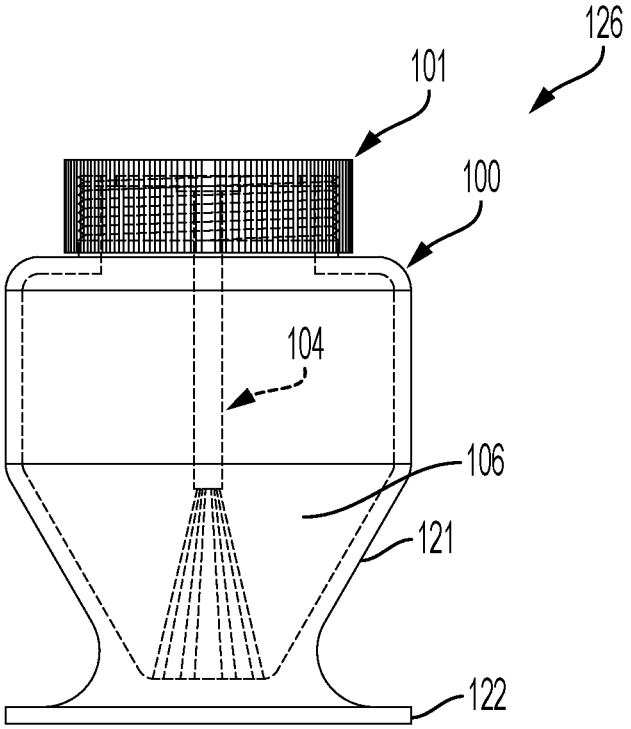
FIG. 7 shows a cross-sectional view of an applicator bottle in a yet further embodiment.

FIG. 7 shows an alternative embodiment wherein the exterior 101 conforms to the interior 106 at the funnelled section 105. In accordance with this embodiment, the container 100 may define a base 122 and wherein the exterior 101 diverges out at the base 122.

Figure 8:
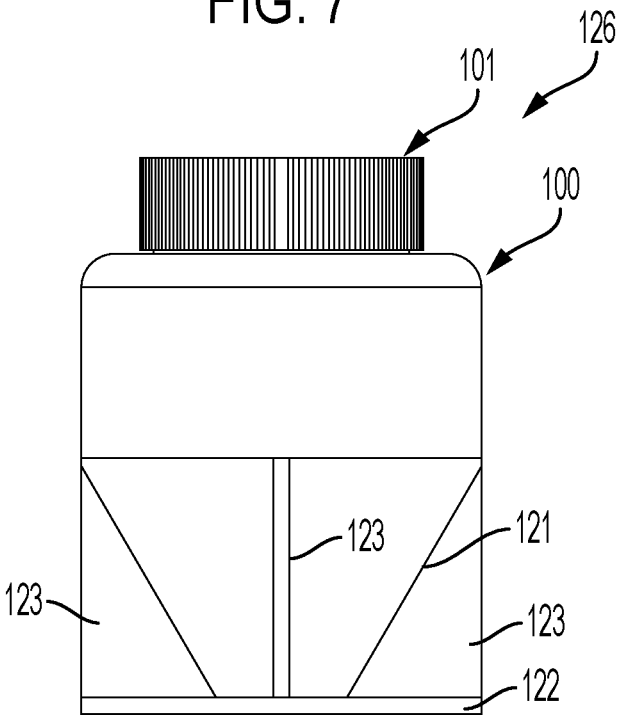
FIG. 8 shows an elevation view of an applicator bottle in accordance with a yet further embodiment.

FIG. 8 shows a yet further embodiment wherein the conforming exterior 121 is supported from the base 122 by generally triangular flanges 123.

FIG. 9 shows an embodiment wherein the container 100 is relatively narrow and wherein the funnelled interior 106 has a steep interior angle. The container 100 may be suited for cosmetics. Further in accordance with this embodiment, the applicator 104 may comprise radially orientated bristles 124. The interior 106 may define a constriction 125 above the funnelled section 105 which squeezes the bristles 124 to remove excess fluid therefrom.

FIG. 10 shows a yet further embodiment wherein the container 100 is similarly somewhat narrower than the embodiment shown in FIGS. 1-8. The container 100 in accordance with this embodiment may be used for nail varnish or the like and the applicator 104 may comprise the generally longitudinally orientated splayed bristles 110. The container 100 in accordance with this embodiment may be made of glass.

In embodiments, as opposed to wherein the applicant 104 comprises a brush, dauber or the like, the bottle 126 may be used as a pump spray bottle, (such as for nasal spray) wherein a distal end of a suction tube thereof collocates concentrically towards the floor to collect pooled fluid.

Figure 11:
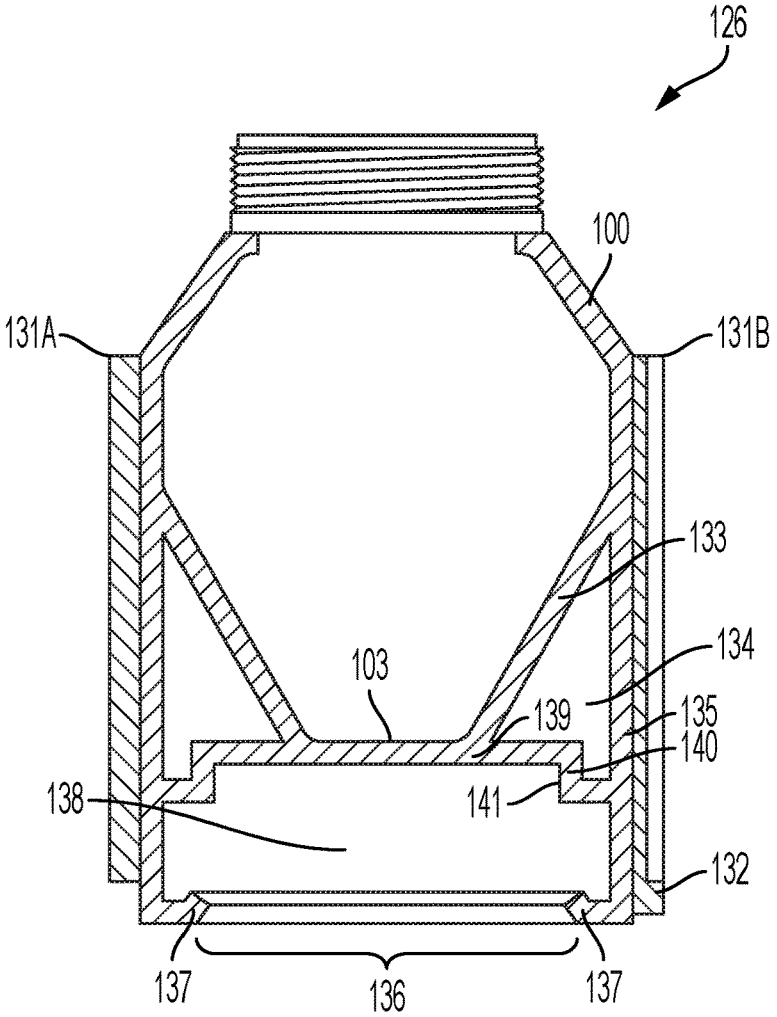
FIG. 11 shows a cross-sectional view of an applicator bottle in accordance with a further embodiment.
Figure 12:
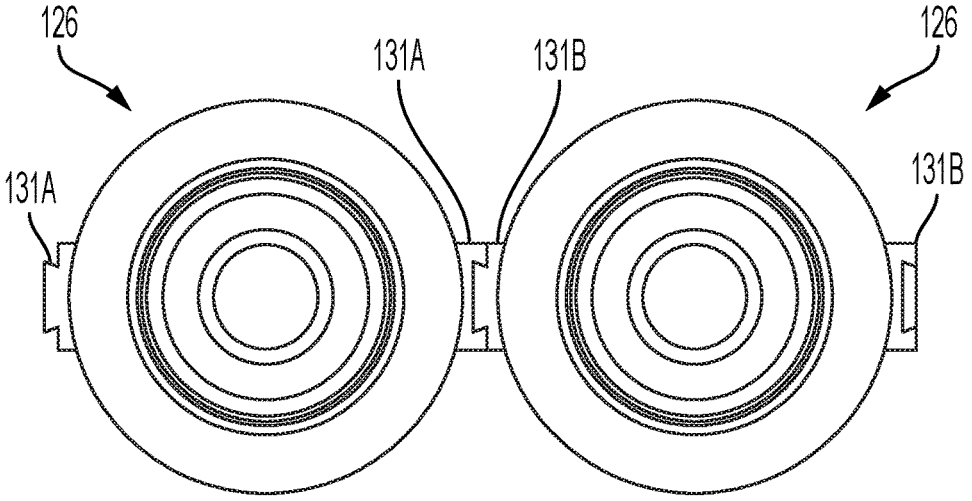
FIG. 12 shows a top plan view of the applicator bottle of FIG. 11.

FIGS. 11 and 12 shows an embodiment wherein the applicator bottle 126 can be interlocked adjacently with other applicator bottles 126.

Figure 14:
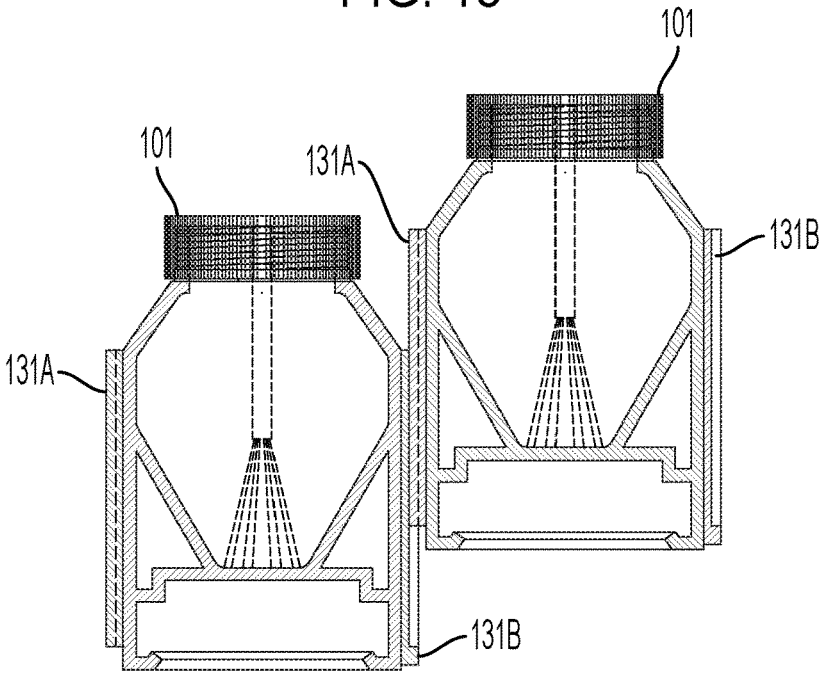
FIG. 14 shows a cross-sectional view of further exemplary use of the applicator bottle of FIG. 11.

In accordance with this embodiment, the applicator bottle 126 comprises a vertical side interlocking rail 131 configured to slidably vertically interlock with a conforming vertical side rail 131 of an adjacent bottle in the manner shown in FIG. 14.

With reference to FIG. 12, the bottle 126 may comprise a female rail 131B which slidably accepts a male rail 131A therein. These rails 131 may define a dovetail interlock cross sections so that the rails 131 cannot be pulled apart horizontally.

Preferably the applicator bottle 126 has interlocking rails 131 on both sides of the container 100 and spaced 180° apart so that applicator bottles 126 may be interlocked in a row.

In an alternative embodiment of the (not shown), the interlocking rails 131 spaced at 90° so that applicator bottles 126 can be interlocked at right angles and, in embodiments, four applicator bottles 126 can be interlocked in a quadrant wherein each applicator bottle 126 interlocks with a pair of interlocking rails 131 of a respective pair of adjacent applicator bottles 126.

The male interlocking rail 131A may have a continuous cross-section along the entire length thereof. However, the female interlocking rail 131B may be closed at the bottom end thereof with a bottom end wall 132 to arrest the further downward travel of the male interlocking rail 131A so that adjacently interlocked applicator bottles 126 are vertically aligned when horizontally interlocked.

Figure 13:
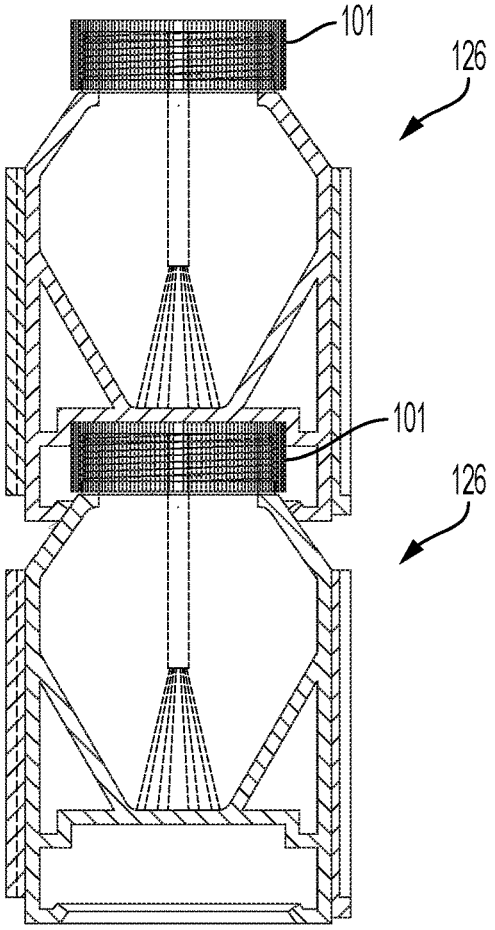
FIG. 13 shows a cross-sectional view of exemplary use of the applicator bottle of FIG. 11.

FIG. 11 also shows an embodiment wherein the applicator bottle 126 is configured to be vertically stacked in the manner shown in FIG. 13.

In accordance with this embodiment, a bottom portion of the container 100 defines a void 138 for receipt of a lid 101 of another applicator bottle 126 thereunderneath.

In accordance with this embodiment, the container 101 may comprise a cylindrical outer wall 135 and a frustoconical interior wall 133 converging towards a base panel 139 to define the floor 103 of the container 101 and wherein the cylindrical outer wall and the base panel define the void.

The base panel 139 may interface a stepdown periphery 140 to thereby define an inner face 141 which engages the lid 101.

Preferably, the inner face 141 is sized to frictionally engage the lid 101 of the other applicator bottle 126 thereunderneath. In accordance with the embodiment shown, the inner face 141 has a circular cross-section so as to officially engage the cylindrical lid 101 of the other applicator bottle 126 thereunderneath. In an alternative embodiment, the inner face 141 may comprise interior threading and wherein the exterior of the lid 101 comprises exterior threading so that the lid 101 can be screwed into the inner face 141.

An entrance 136 into the void 138 may be bounded by an inwardly angled edge which would guide the lid 101 into the void to engage the inner face 101 and resist dislodgement of the lid 101 from the void 138.

In accordance with a preferred embodiment shown in FIG. 11, the applicator bottle 126 is configured both for adjacent interlocking and vertical stacking. In accordance with this embodiment, lower ends of the interlocking rails 131 may be vertically coextensive with the void 138.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The invention claimed is:

1. A bottle having a container comprising:

a cylindrical outer wall;

a base panel recessed with respect to the cylindrical outer wall;

a frustoconical interior wall; and a floor at an interior of the bottle, opposite an opening of the bottle, wherein:

the frustoconical interior wall extends continuously downward to terminate at the floor;

the floor is a planar surface spanning between the frustoconical interior wall;

the cylindrical outer wall and the base panel define a bottom stacking void; and the frustoconical interior wall converges from an inner surface of the cylindrical outer wall to the base panel.

2. The bottle as claimed in claim 1, further comprising an applicator having a lid and wherein a floor is defined by the base panel within the frustoconical interior wall and wherein the applicator is configured to reach the floor when the lid engages a neck the container.

3. The bottle as claimed in claim 2, wherein the applicator has a planar distal end.

4. The bottle as claimed in claim 2, wherein a distal end of the applicator is sized to entirely cover the floor.

5. The bottle as claimed in claim 2, wherein the floor is wider than a distal end of the applicator.

6. The bottle as claimed in claim 2, wherein an opening of the container defines a wiping shelf partially thereacross.

7. The bottle as claimed in claim 2, wherein the applicator is configured to compress against the floor when the lid engages the neck.

8. The bottle as claimed in claim 2, wherein the applicator comprises bristles.

9. The bottle as claimed in claim 2, wherein the applicator comprises a dauber.

10. The bottle as claimed in claim 2, wherein the container defines a constriction configured to squeeze the applicator.

11. The bottle as claimed in claim 1, wherein the void defines a peripheral edge configured to frictionally engage a lid.

12. The bottle as claimed in claim 11, wherein the peripheral edge comprises interior threading.

13. The bottle as claimed in claim 1, wherein the container forms an inwardly angled edge at an entrance to the void.

14. A bottle having a container comprising:

a cylindrical outer wall;

a base panel recessed with respect to the cylindrical outer wall;

a frustoconical interior wall; and an applicator having a lid and wherein a floor is defined by the base panel within the frustoconical interior wall and wherein the applicator is configured to reach the floor when the lid engages a neck the container, wherein:

the cylindrical outer wall and the base panel define a bottom stacking void; and the frustoconical interior wall converges from an inner surface of the cylindrical outer wall to the base panel.

15. The bottle as claimed in claim 14, wherein an opening of the container defines a wiping shelf partially thereacross.

16. The bottle as claimed in claim 14, wherein the void defines a peripheral edge configured to frictionally engage a lid.

17. The bottle as claimed in claim 14, wherein the container forms an inwardly angled edge at an entrance to the void.

18. A bottle having a container comprising:

a cylindrical outer wall;

a base panel recessed with respect to the cylindrical outer wall; and a frustoconical interior wall, wherein:

the cylindrical outer wall and the base panel define a bottom stacking void;

the frustoconical interior wall converges from an inner surface of the cylindrical outer wall to the base panel; and the void defines a peripheral edge configured to frictionally engage a lid.

19. The bottle as claimed in claim 18, further comprising an applicator having a lid and wherein a floor is defined by the base panel within the frustoconical interior wall and wherein the applicator is configured to reach the floor when the lid engages a neck the container.

20. The bottle as claimed in claim 18, wherein an opening of the container defines a wiping shelf partially thereacross.

* * * * *